US007377382B2

(12) United States Patent
Borg et al.

(10) Patent No.: US 7,377,382 B2
(45) Date of Patent: May 27, 2008

(54) MULTIPLE CONTAINER CARRIER

(75) Inventors: Zakary James Borg, Eugene, OR (US); William Buel, Eugene, OR (US)

(73) Assignee: Oregon Precision Industries, Inc., Eugene, OR (US)

( * ) Notice: Subject to any disclaimer, the term of this patent is extended or adjusted under 35 U.S.C. 154(b) by 249 days.

(21) Appl. No.: 11/207,519

(22) Filed: Aug. 19, 2005

(65) Prior Publication Data

US 2007/0039836 A1 Feb. 22, 2007

(51) Int. Cl.
*B65D 75/00* (2006.01)

(52) U.S. Cl. ..... 206/150; 206/153; 294/87.2

(58) Field of Classification Search ..... 206/150, 206/160–163, 153; 294/87.2, 159, 166, 33, 294/148

See application file for complete search history.

(56) References Cited

U.S. PATENT DOCUMENTS

| | | | | |
|---|---|---|---|---|
| 2,989,177 | A * | 6/1961 | Swick | 206/150 |
| 3,268,070 | A * | 8/1966 | Cunningham | 206/150 |
| 3,269,530 | A * | 8/1966 | Wanderer | 206/150 |
| 4,545,480 | A * | 10/1985 | Klygis | 206/151 |
| 4,782,955 | A * | 11/1988 | Weaver et al. | 206/161 |
| 6,129,397 | A | 10/2000 | Borg | |

* cited by examiner

*Primary Examiner*—David T Fidei
(74) *Attorney, Agent, or Firm*—Chernoff Vilhauer McClung & Stenzel LLP

(57) ABSTRACT

An integral carrier for carrying multiple containers by their necks is disclosed that has a plurality of annular neck-engaging structures and a pair of centrally located opposing finger loops that promote a balanced distribution of weight for ease in carrying and handling.

15 Claims, 4 Drawing Sheets

MULTIPLE CONTAINER CARRIER

BACKGROUND OF THE INVENTION

Six-pack or multiple bottle carriers which hold bottles or containers by their necks to allow them to be carried are well known. The bottles typically have labels to advertise their contents. A common type of commercially available prior art carrier is fabricated from thin gauge sheets of plastic. The thin planar sheet is die-cut to provide holes for engaging the necks of the containers and holes for grasping the carrier, and is thermo-formed into a three dimensional shape to provide structural integrity to the carrier. There are several problems with this carrier. First, the thermo-formed plastic sheet shrouds the container, obscuring visibility of the product and product labels. Second, the thin gauge of the plastic material makes the carrier uncomfortable to carry. Further, the thin gauge material requires a substantial amount of structural surface area to support the containers. This tends to further hide the product in the containers and advertising on the labels.

Another carrier design is disclosed in U.S. Pat. No. 3,633,962. It has keyhole-shaped neck retainers and sharp edges on both the neck retainers and the finger holes. This carrier is also uncomfortable to carry due to its sharp edges. In addition, the rigid keyhole-shaped neck retainers are difficult to fit over the neck flanges of the containers, and likewise it is difficult to remove the containers from the carrier due to the rigid key hole-shaped neck retainers.

Commonly owned U.S. Pat. No. 6,129,397 discloses a six pack carrier design that overcomes the aforementioned drawbacks of the prior art. However, that carrier design allows the outboard containers to sag a bit due to inadequate support for them when the loaded carrier is lifted by the carrier's handholds.

What is needed is a carrier that is comfortable to carry, allows for excellent visibility of the product in the containers and the labels on the containers, allows for easy application and removal of the containers from the carrier, and provides good balance in carrying and handling containers.

BRIEF SUMMARY OF THE INVENTION

There are essentially two aspects to the present invention, both of which comprise an integrally-molded carrier for carrying multiple containers by their necks by grasping a pair of opposing finger loops.

In a first aspect, the carrier has a substantially planar web defining a pair of centrally located annular support openings. Each support opening has a finger loop disposed therein with the two finger loops in substantial mirrored alignment. Each finger loop is attached to the annular opening at two points tangent to the two outermost container neck-engaging structures. The carrier has a plurality of annular neck-engaging structures integral with the web and arranged around the periphery of the support openings. Each of the neck-engaging structures has a respective circumferential rib and a plurality of flanges projecting inwardly from the circumferential rib for releasably engaging the necks of the containers.

In a second aspect, there is provided a plurality of the same type of neck-engaging structures as noted above, the neck-engaging structures being secured together by smaller gap-bridging elements and having a pair of centrally disposed larger gaps that accommodate a pair of finger loops in substantial mirrored alignment.

DETAILED DESCRIPTION OF PREFERRED EMBODIMENTS

Figure 1:
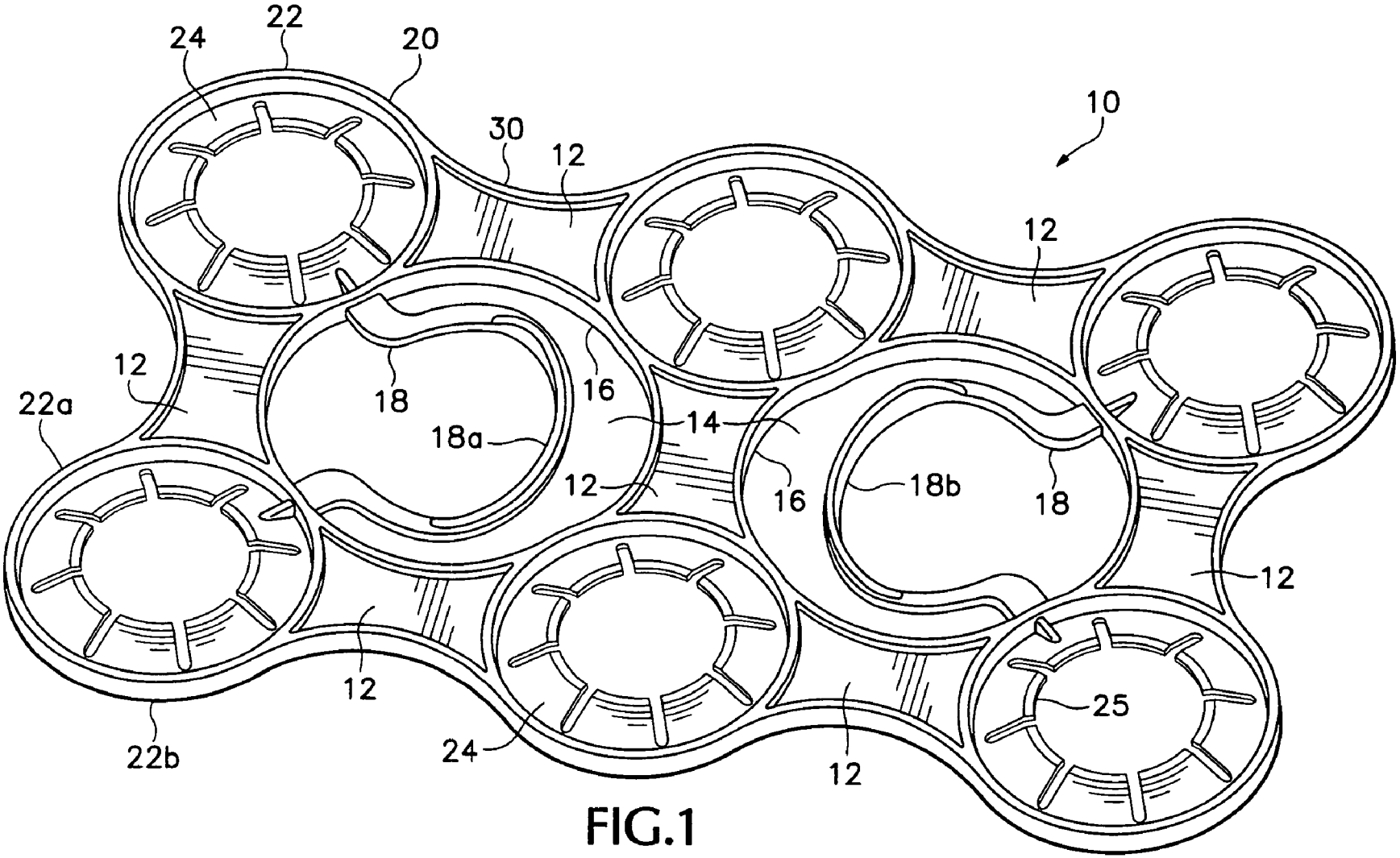
FIG. 1 is a perspective view of an exemplary carrier of the invention.
Figure 2:
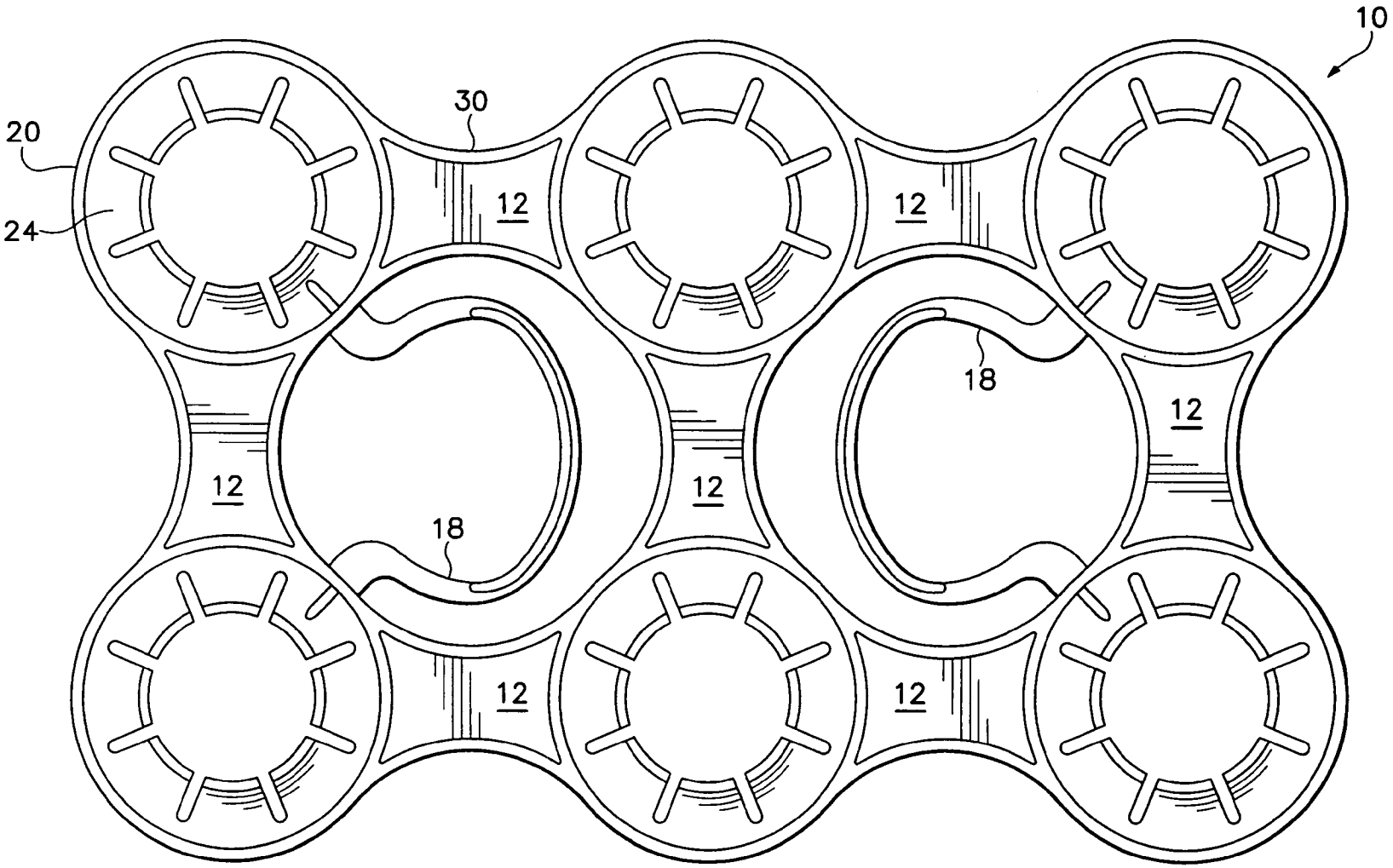
FIG. 2 is a plan view of the carrier of FIG. 1.
Figure 3:
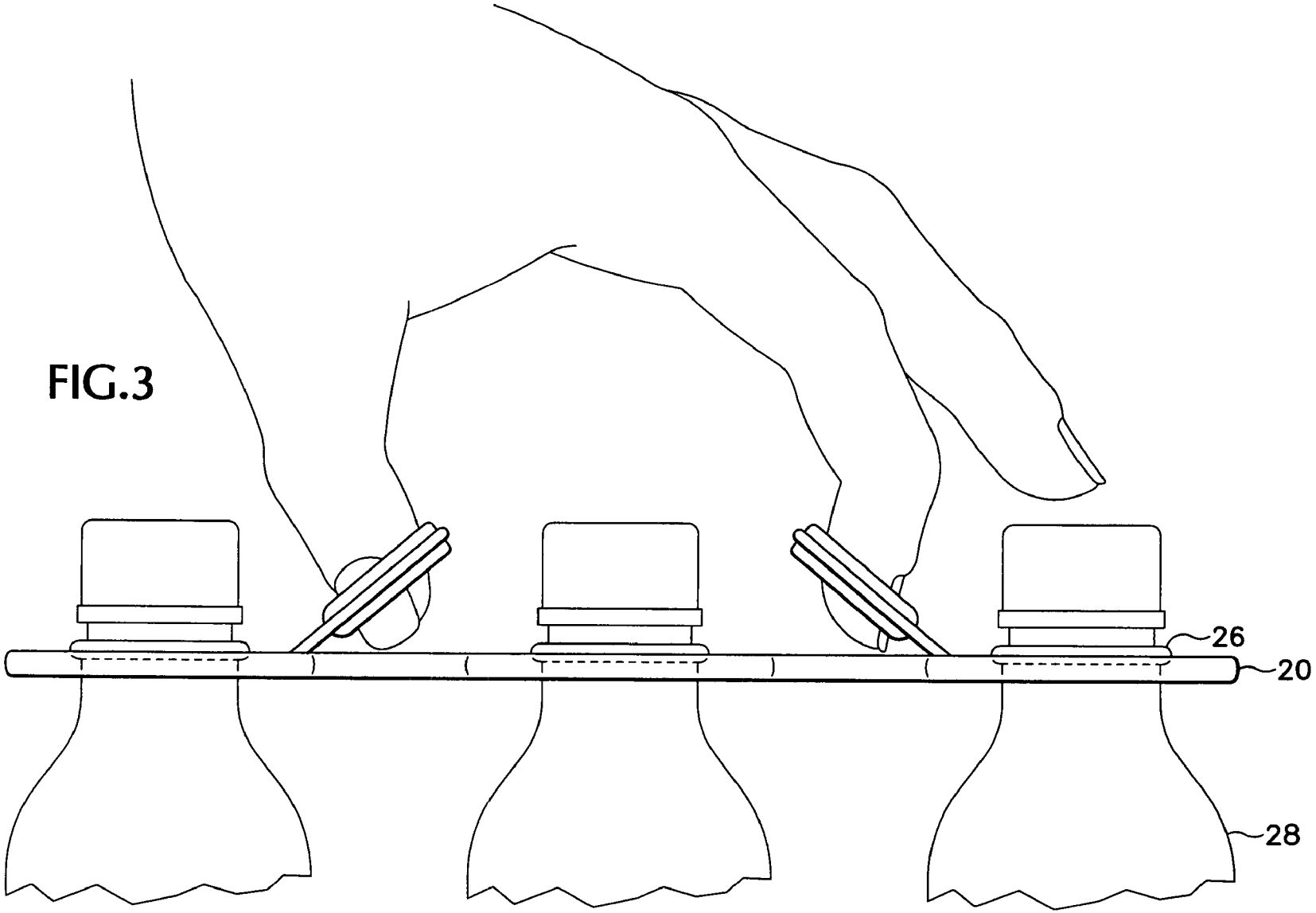
FIG. 3 is a side view of the carrier of FIG. 1 shown in place on multiple containers.

Referring to the drawings, wherein like numerals generally refer to the same elements, there is shown in FIGS. 1-3 an integral carrier 10 for carrying multiple containers. Carrier 10 has a web 12 that is substantially planar. Web 12 has a pair of centrally located annular support openings 14. Each support opening 14 is surrounded by a support rib 16 and has a finger loop 18 situated therein. Surfaces 18*a* and 18*b* of finger loops 18 are preferably radiused to provide comfortable gripping surfaces for carrying the carrier. Each finger loop 18 flattens at its points of attachment to the support rib 16 to increase upward flexibility upon lifting. The points of attachment of finger loops 18 to the support rib 16 are tangent to the outermost neck-engaging structures 20.

A plurality of identical annular neck-engaging structures 20 are integral with the web 12 and are arranged around the periphery of the support openings 14. Each neck-engaging structure 20 has a respective circumferential rib 22. Each circumferential rib 22 has a radiused upper and lower surface 22*a* and 22*b*, respectively. Each neck-engaging structure 20 further has a plurality of flanges 24 projecting inwardly from circumferential rib 22 for releasably engaging the necks 26 of the containers 28. The flanges 24 are oriented upwardly and comprise sections of a truncated cone. The inner edges 25 of flanges 24 form a circle and engage the necks 26 of the containers 28, allowing carrier 10 to secure and support the containers.

Interconnecting each of the neck-engaging structures 20 are external ribs 30. External ribs 30, like support ribs 16 and circumferential ribs 22, have radiused upper and lower surfaces. These interconnecting ribs add dimensional support to the carrier, much like I beams in a framed structure.

In a preferred embodiment, the thickness of flanges 24 is 20-25 mils, the thickness of ribs 16, 22 and 30 and web 12 is 60 mils each, and the height of ribs 16, 22 and 30 is 180 mils. Support ribs 16 surrounding the support openings 14 and external ribs 30 interconnecting the neck engaging structures 20 preferably have the same radius.

Figure 4:
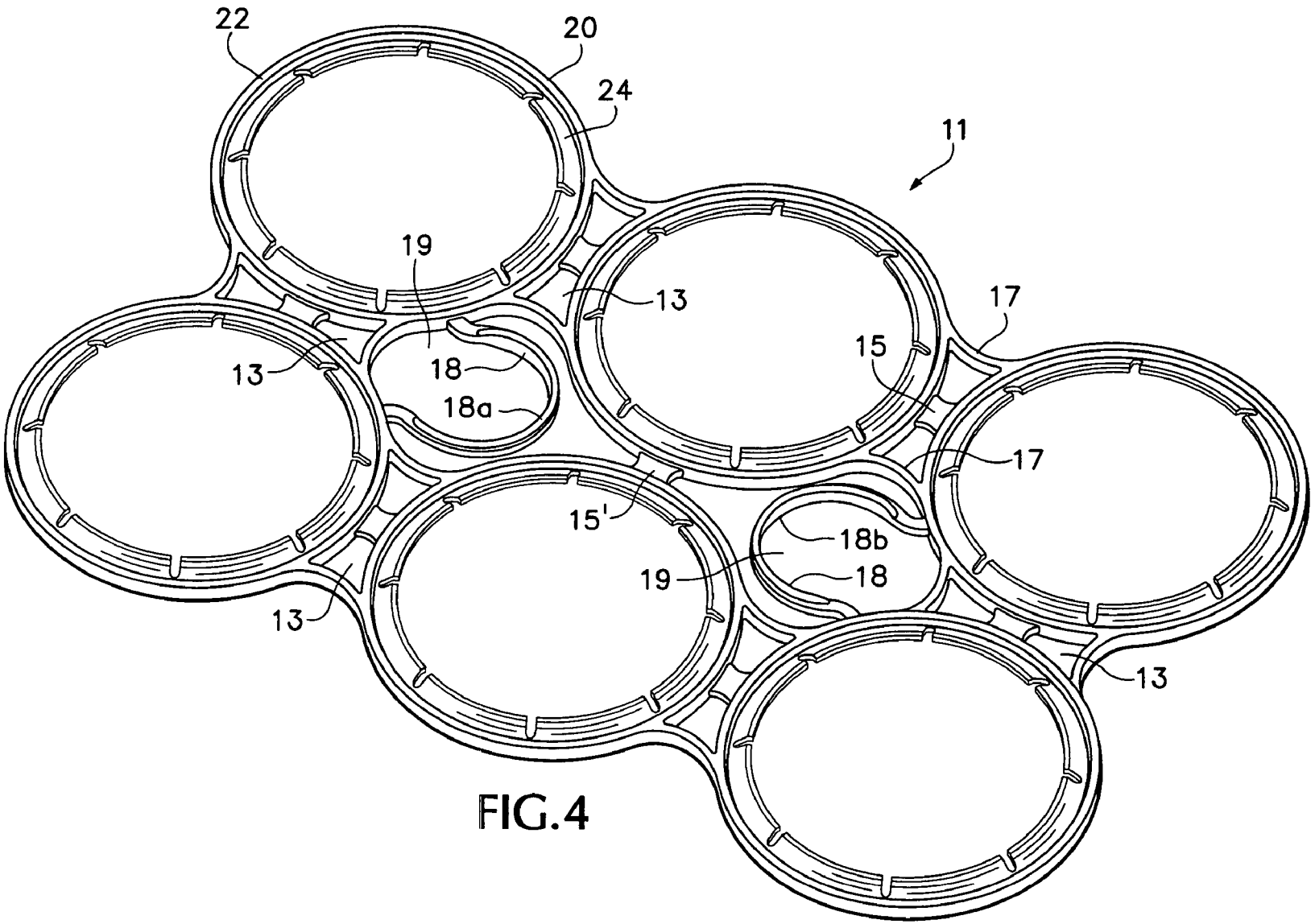
FIG. 4 is a perspective view of another exemplary carrier of the invention, showing the upward flexing of the finger loops as it is lifted by a hand.

In a second embodiment, there is shown in FIG. 4 an integrally molded carrier 11, also designed for carrying multiple containers. Carrier 11 comprises a plurality of neck-engaging structures 20 with smaller gaps 13 between them that are bridged by bridging tabs 15 and a pair of radial ribs 17, tabs 15 and ribs 17 securing the neck-engaging structures 20 to one another. Neck-engaging structures 20 are substantially the same design as shown in FIGS. 1-2. Larger gaps 19 are created by omitting radial ribs 17 on either side of tab 15', thereby allowing sufficient room to accommodate a pair of opposing finger loops 18. Finger loops 18 preferably also have radiused upper and lower surfaces 18*a* and 18*b* and are flat at the points of attachment to the outer neck-engaging structures 20.

The carrier is manufactured using high pressure injection molding of heated and liquified polymer into a three-dimensional cavity, and is preferably made of a flexible material such as a polyolefin. In a most preferred embodiment, the polyolefin is high density polyethylene (HDPE) that has a tensile strength from about 4000 to about 5000 psi, and a brittleness temperature of less than −30° C. This material is readily recyclable, in contrast to the material used to make conventional die-cut thermo-formed carriers.

The carrier of the present invention concentrates structure into three-dimensional ribs, thereby reducing the surface area required to support containers. At the same time, this minimal surface area provides for a quality appearance while utilizing less material. The carrier is essentially planar and so does not obscure the container or product therein or labels, but instead provides high product and label visibility.

In addition, the thick ribs and radiused edges of the ribs and pair of opposing finger loops provide outboard points of attachment for superior comfort for lifting and carrying the carrier, and superior balance for carrying and handling containers. The carrier also provides superior release of the containers. The circumferential ribs around the angled, thin conical flanges provide support for the containers. The thin flanges easily flex to allow the containers to be removed by either lifting the carrier relative to the container or pulling the container down and away from the carrier.

EXAMPLES

Carriers of substantially the same designs shown in FIGS. 1-2 and 4 were fabricated by injection molding from HDPE having a specific gravity of 0.962, with a tensile strength of about 4800 psi (33 mPa), a flexural strength of about 7000 psi (48 mPa) and a brittleness temperature of approximately −30° C.

The so-fabricated carriers were easily and quickly secured over the annular flanges of six 12-ounce bottles (FIG. 1 embodiment) and over six 12-ounce aluminum cans (FIG. 4 embodiment) by placing the neck-engaging structures 20 over the bottle necks/can tops and pushing them down until the flanges 24 of the neck-engaging structures engaged the annular flanges 26 on the necks of containers 28 as illustrated in FIG. 3. The carrier secured and supported the containers, yet readily disengaged by simply pulling the containers downward and away from the carrier.

The same basic neck-engaging structures with opposing finger loops may be incorporated into other multiple container carriers, such as carriers for fewer or more than six containers.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. An integrally molded carrier for carrying multiple containers by their necks, comprising:

(a) a substantially planar web having a top surface and a bottom surface, said web defining a pair of centrally located annular support openings, said support openings being surrounded by support ribs and having a pair of substantially aligned opposing finger loops disposed within and secured to said support openings;

(b) a plurality of annular neck-engaging structures integral with said web and arranged around the periphery of said support openings, each of said neck-engaging structures having a respective circumferential rib and a plurality of flanges projecting inwardly from said circumferential rib for releasably engaging the necks of the containers, wherein each of said neck-engaging structures is connected to an adjacent neck-engaging structure by said support ribs and by an external rib on the periphery of said web; and c) wherein said loops are non-fracturably secured to the support ribs at points of attachment proximal to the four outermost neck-engaging structures.

2. The carrier of claim 1 wherein each of said pair of finger loops has two ends which flatten near their points of attachment to said support openings.

3. The carrier of claim 2 wherein said support ribs are annular and wherein said pair of finger loops is secured to said support ribs.

4. The carrier of claim 3 with six neck-engaging structures.

5. The carrier of claim 4 wherein said plurality of flanges are oriented upwardly and comprise sections of a truncated cone.

6. The carrier of claim 5 formed of a flexible material.

7. The carrier of claim 6 wherein said flexible material is high density polyethylene.

8. The carrier of claim 7 wherein said polyethylene is recyclable.

9. An integrally molded carrier for carrying multiple containers by their necks, comprising:

(a) a plurality of annular neck-engaging structures with gaps therebetween, each of said neck-engaging structures having a respective circumferential rib and plurality of flanges projecting inwardly from said circumferential rib for releaseably engaging the necks of the containers, wherein each of said neck-engaging structures is connected to an adjacent neck-engaging structure by at least a bridging tab; and (b) a pair of substantially aligned opposing finger loops non-fracturably secured to said circumferential ribs at points of attachment proximal to the four outermost neck-engaging structures.

10. The carrier of claim 9 including a pair of support ribs arranged on either side of said bridging tab.

11. The carrier of claim 10 with six neck-engaging structures.

12. The carrier of claim 11 wherein said plurality of flanges are oriented upwardly and comprise sections of a truncated cone.

13. The carrier of claim 12 formed of a flexible material.

14. The carrier of claim 13 wherein said flexible material is high density polyethylene.

15. The carrier of claim 14 wherein said polyethylene is recyclable.

* * * * *